United States Patent [19]

Rumrill

[11] 3,952,905

[45] Apr. 27, 1976

[54] CONTAINER HOLDER FOR ICE CREAM CABINET OR THE LIKE

[75] Inventor: Howard J. Rumrill, Gloversville, N.Y.

[73] Assignee: Pet Incorporated, St. Louis, Mo.

[22] Filed: Sept. 23, 1974

[21] Appl. No.: 508,686

[52] U.S. Cl. ..... 220/14; 220/17; 312/236; 312/293; 312/351

[51] Int. Cl.[2] ..... A47B 57/18; A47B 77/18; A47F 3/022; A47F 3/04

[58] Field of Search ..... 211/89; 220/14, 17, 220/18, 327, 328; 248/154, 316 R; 292/260; 312/265, 351, 293

[56] References Cited

UNITED STATES PATENTS

| | | | |
|---|---|---|---|
| 694,267 | 2/1902 | Griesser | 292/260 |
| 2,081,362 | 5/1937 | McGinnis | 220/14 |
| 2,089,698 | 8/1937 | Horton | 220/14 |
| 2,319,421 | 5/1943 | MacLaren | 220/17 |
| 2,647,656 | 8/1953 | Frisch | 220/328 X |
| 2,878,958 | 3/1959 | Banker | 220/14 X |
| 3,139,559 | 6/1964 | Heidler | 312/265 UX |

FOREIGN PATENTS OR APPLICATIONS

| | | | |
|---|---|---|---|
| 10,592 | 10/1912 | United Kingdom | 220/327 |

*Primary Examiner*—Paul R. Gilliam
*Assistant Examiner*—Carl F. Pietruszka
*Attorney, Agent, or Firm*—Richard G. Heywood

[57] ABSTRACT

A container holder for use in refrigerated cabinets have a top plate with an opening to receive a container with refrigerated product to be dispensed, the holder including a bottom support for seating the container and a top retaining ring removably locked into the opening in the top plate, and means for vertically adjusting the bottom support against the top retaining ring to firmly, but removably, secure the container therebetween.

11 Claims, 3 Drawing Figures

CONTAINER HOLDER FOR ICE CREAM CABINET OR THE LIKE

BACKGROUND OF THE INVENTION

The invention relates generally to holders for food containers, and more particularly to a container holder for use in refrigerated cabinets.

In the past many support or holder structures have been designed for use in refrigerated cabinets to support bulk containers from which various food products can be dispensed, such as ice cream, potato salad, etc. Ice cream for dispensing in bulk at soda fountains, for example, is generally packed in standard 2½ or 3 gallon disposable fiberboard containers of cylindrical form and, due to the low temperatures necessary to maintain a frozen condition, require a more secure support structure than normal (non-frozen) temperature products such as potato salad. In addition, prior support structures have been relatively complex utilizing extra inserts or camming mechanisms to accommodate various container diameters and vertical adjustments, and to clamp or hold several containers together. Another problem in the past has been the inability to vertically adjust the container and retain it firmly in the holder assembly as may be necessary due to depletion of ice cream or other reasons causing softening of the container (called container collapse). In short, the previous container holders for refrigerated cabinets have presented problems in assembly, usage, cleaning and maintenance or repair.

SUMMARY OF THE INVENTION

The present invention relates to a container holder for refrigerated cabinets, having a removable top retaining collar and a lower container support that is vertically adjustable relative thereto.

A primary object of the invention is to provide a container holder adapted to relatively immovably support a single container for bulk food product in a refrigerated cabinet for dispensing portions thereof.

Another object is to provide a container holder that is vertically adjustable to maintain a container firmly retained during depletion of the food product, or oppositely, to release an emptied container for repalcement.

Another object of the invention is to provide a novel sanitary holder particularly adapted for use in ice cream cabinets in soda fountains where ice cream is dispensed in individual scoops from a bulk container supported in the cabinet by the sanitary holder.

Still another object is to provide a container holder of simple construction, requiring few parts but operating efficiently and being easily cleaned and replaced.

Another object of the invention is to provide a container holder having a retaining collar for ice cream cabinets with means to level off the ice cream in the scoop used in dispensing the product.

There and still other objects and advantages of the invention will be more fully and clearly apparent from the specification and claims hereinafter.

BRIEF DESCRIPTION OF THE DRAWINGS

In the drawings which illustrate a preferred embodiment of the present invention, and in which like numerals refer to like parts wherever they occur.

DESCRIPTION OF THE PREFERRED EMBODIMENTS

Figure 1:
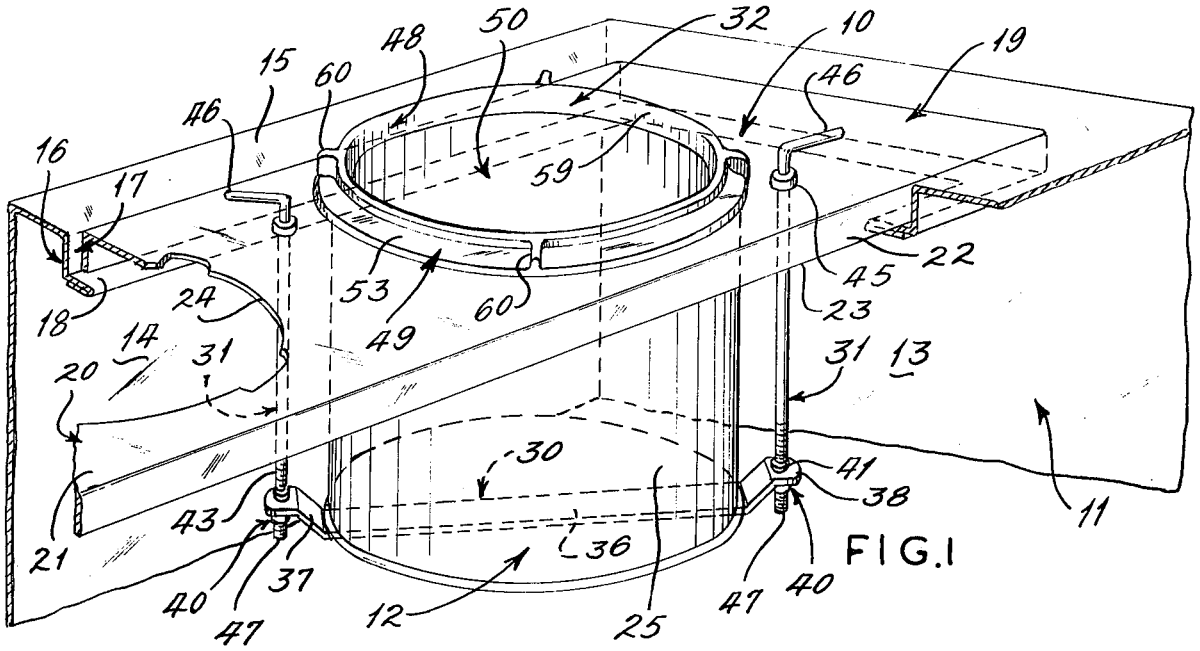
FIG. 1 is a perspective view, partly broken away, showing a container holder for ice cream embodying the present invention.

Referring to the drawings, a container holder 10 for ice cream or the like embodying the present invention is shown in combination with a typical refrigerated housing or cabinet 11 of the kind normally referred to as "dipping cabinets" as used in soda fountains or the like for dispensing ice cream from large cylindrical containers 12 holding 2½ or 3 gallons of ice cream or such in bulk. The cabinet 11 is only partially illustrated and, in addition to side and back walls 13 and 14 and other enclosing structures such as bottom and front walls or doors (not shown), includes a fixed top wall 15 forming a part of the counter top or work surface of the soda fountain (not shown). The refrigeration system forms no part of this invention and is not illustrated, but cools the cabinet to low refrigeration temperatures in the range of about 0°F. to 20°F. sufficient to maintain the ice cream in a firm or frozen, but workable condition although it will be readily apparent that other bulk food products may be similarly retained and dispensed from refrigerated cabinets operating at other temperatures. The top wall 15 is formed with a right-angular flanged ledge 16 defining an opening 17 and peripheral supporting ledges 18 for receiving a removable top plate 19 commonly called a "drip tray" and a conventional spacer unit (not shown) may be required in certain dipping cabinets 11.

The drip tray 19 comprises a top wall 20 with an upper work surface 21, and peripheral vertical side walls 22 with bottom margins 23 that are seated on the ledges 18 of the top wall 15 so that the top wall 15 and upper surface 21 of the drip tray 19 are conterminous. As shown in the drawings, the drip tray 19 is provided with two openings 24 each of which receives an ice cream container 12, but more or less openings may be provided and a series of such drip trays 19 may be accommodated in a typical dipping cabinet 11.

Figure 3:
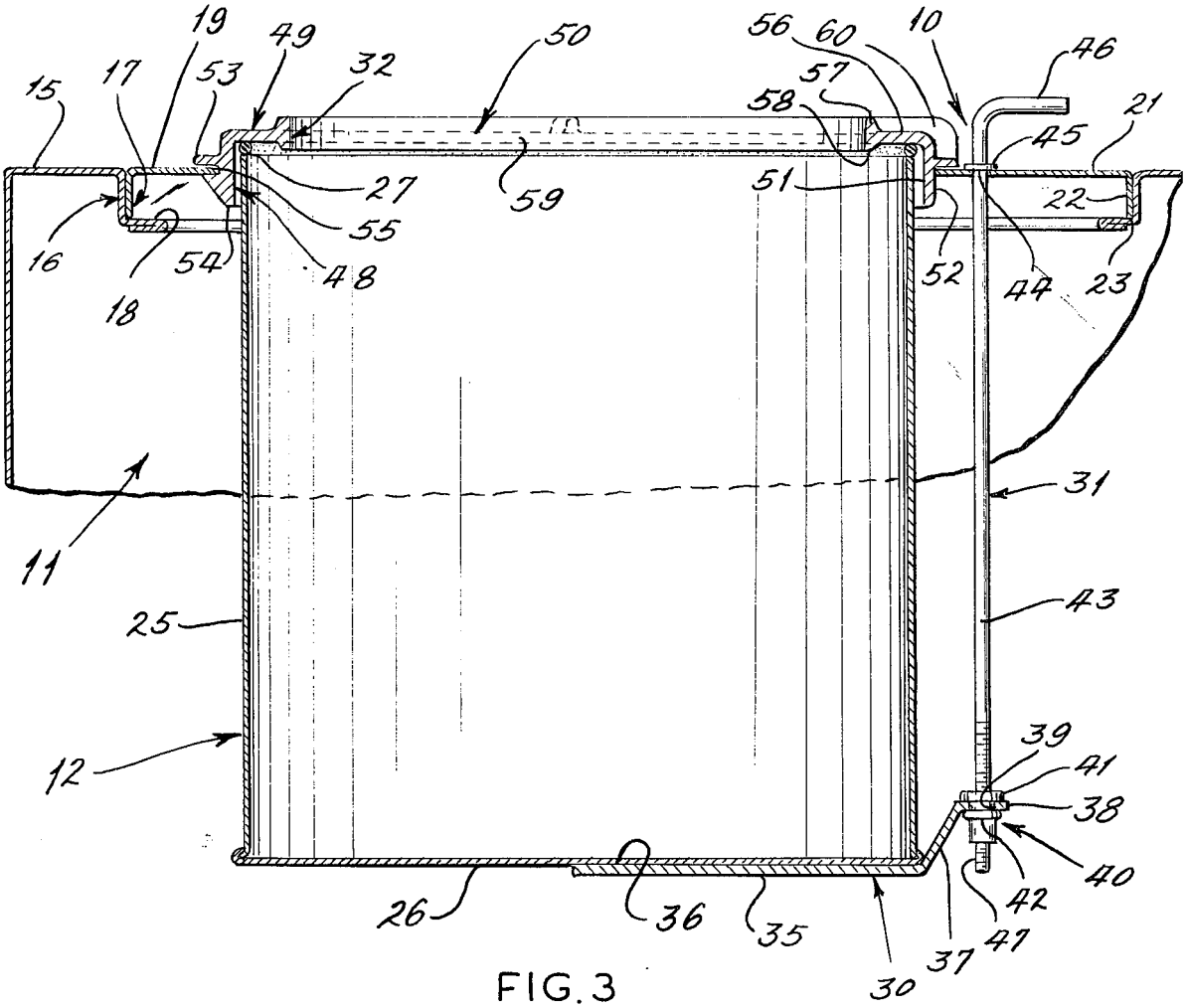
FIG. 3 is a cross-sectional view taken substantially along line 3—3 of FIG. 2.

A typical fiberboard container 12 for ice cream or other refrigerated food products is shown best in FIG. 3 as mounted in the cabinet 11 by the holder 10, and comprises a cylindrical side wall 25, round bottom wall 26 and open annular beaded rim 27 (from which the shipping cover or seal has been removed).

Figure 2:
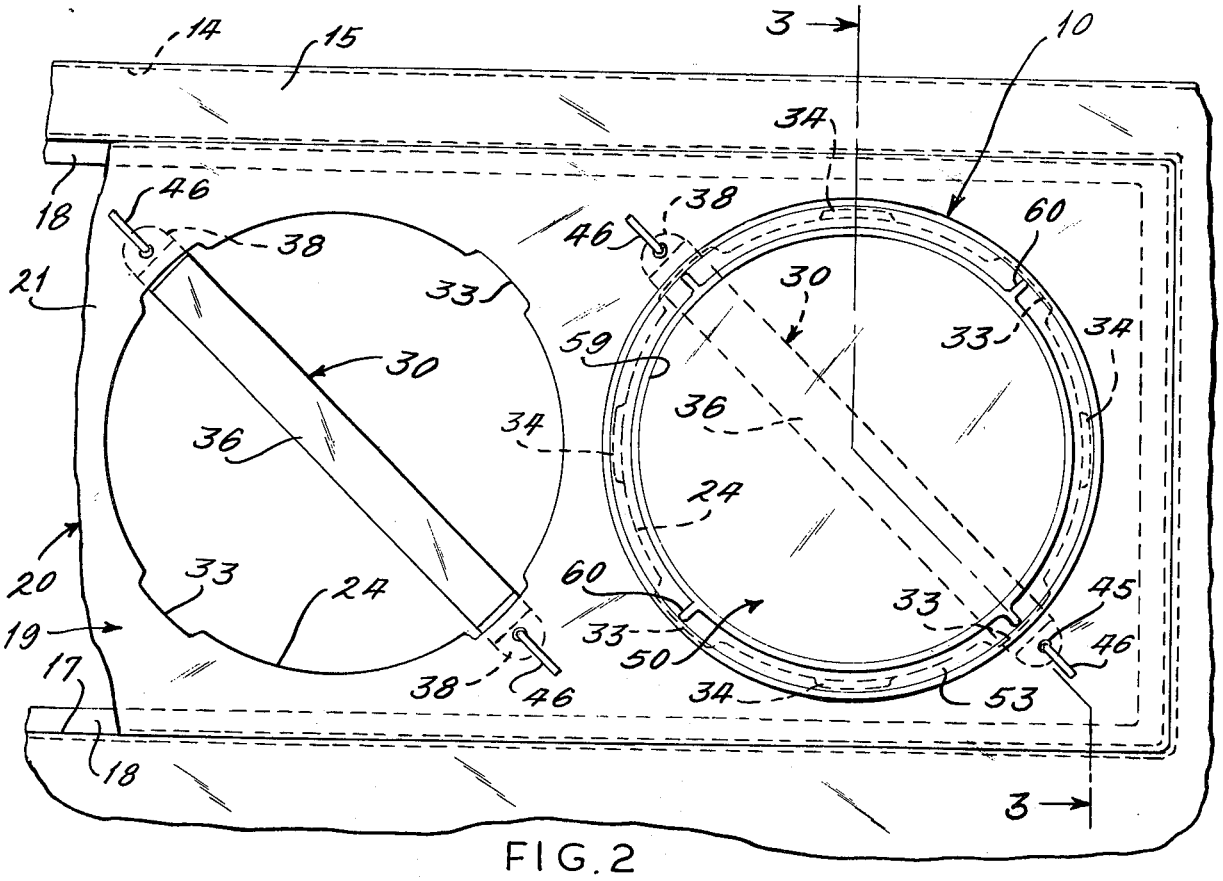
FIG. 2 is a top plan view showing an assembled ice cream container and holder and a holder assembly for receiving another container.

The container holder 10 according to the invention comprises four basic parts (together with sub-assemblies to be described) in combination with cooperating features embodied in the drip tray 19 as will also be described; namely, a container bottom support 30, two vertically disposed threaded rods 31 and an annular upper retaining ring or collar 32. Referring particularly to FIGS. 1 and 2, the circular openings 24 in the top wall 20 of the drip tray 19 have multiple cut-outs or recesses 33 located at equally spaced intervals around the circumference of the opening 24, the recesses 33 in the preferred embodiment being positioned at quadrants of the circular opening 24 and, accordingly, constituting the four recesses as shown. It should be noted that the quadrature position of these recesses 33 is preferably angularly located by 45° from the longitudinal and transverse directions of the drip tray 19 thereby minimizing the overall dimensions of the cabinet 11. As will be further noted, the recesses 33 are provided to receive tabs 34 of the retaining collar 32 for removably locking the collar 32 on the top wall 20 of the drip tray 19, as will be described.

The bottom support 30 has a main horizontally planar body portion or strap 35 with an upper support surface 36 of predetermined length to accommodate the diameter of the largest standard container 12, such as a typical 3 gallon container of approximately 10 inches in diameter, and smaller containers 12 are, of course, easily supported within this dimension. Similarly, the retaining collar 32 has a diametral clearance to accommodate varying sized containers 12, as will be described hereinafter. The ends of the support surface 36 are defined by upwardly angling portions 37 of the bottom support 30, and horizontally extending end flanges 38 extend outwardly therefrom. Each end flange 38 has an opening 39 in which an internally threaded fastener nut 40 is snapped into place and retained by upper and lower flanges portions 41 and 42 of the nut 40.

The vertical jacking rods 31 are positioned in opposed relation on opposite sides outwardly of the opening 24 in the drip tray 19 on a diametral line extending across one pair of opposed recesses 33, and each rod 31 has a main vertical body portion 43 extending through an opening 44 in the drip tray top wall 20 having a bushing or washer 45 thereon. A handle portion 46 is formed at the upper end of each rod 31 above the drip tray 19 and at substantially a right angle to the main body 43 of the rod 31 so that the handle 46 extends parallel to the plane of the work surface 21 of the drip tray 19. The lower end of the main body 43 is threadedly received in the fastener nut 40 on the bottom strap 30, the threads 47 extending a substantial distance from the end to accommodate different height containers 12 and afford flexibility in vertical adjustment.

The retaining ring 32 is formed of a firm plastic material that is machine washable (as are the other parts of the holder 10), and forms an annular collar adapted to be removably locked into place within the opening 24 of the drip tray 19. The retaining ring or collar 32 comprises a substantially L-shaped body having a vertical portion 48 for engagement with the drip tray 19 and a horizontal portion 49 defining the actual access opening 50 for access to the contents of the container 12. The vertical portion 48 includes an annular side wall 51 having an outer surface 52 with a diameter to be received within the circular opening 24 of the drip tray 19, and from which a horizontal flange 53 projects outwardly to form a seating surface 54 for engagement against the work surface 21 of the drip tray 19 and covering the recesses 33 thereof. The locking tabs 34 of the retaining collar 32 are formed in outwardly projecting relation from the side wall 51 spaced below the flange 53 to form a slot 55 therebetween for receiving the top wall 20, and these locking tabs 34 are located at equally spaced intervals around the circumference of the side wall in a manner to coincide with the spacing and arrangement of the recesses 33. The horizontal portion 49 of the retaining collar 32 comprises a horizontally disposed annular wall 56 extending inwardly from the side wall 51 and, at its inner margin, being formed into upwardly and downwardly enlarged portions 57 and 58 with an inner surface 59 defining the access opening 50. The depending projecting portion 58 is spaced within the container 12 and is particularly adapted for leveling off portions of the ice cream or like product scooped or dispensed therefrom. The retaining collar 32 also includes equally spaced ribs 60 which, in the preferred embodiment, are located at quadrants around the circumference of the collar 32 and extend radially outwardly from the upward portion 57 across the side wall 51 to the horizontal flange 53. These ribs 60 not only strengthen the collar structure, but are important in proper orientation thereof in locking engagement with the drip tray 19.

As previously described, the container holders 10 of the present invention will accommodate a range of different sized containers 12, both in diameter and height, and utilize a minimum number of easily cleaned parts.

In assembly and operation, the threaded rods 31 are inserted through the bushings 45 and holes 44 of the drip tray 19 and threaded into the fastening nuts 40 on opposite end flanges 38 of the bottom support 30. With the drip tray 19 now positioned with the side wall margins 23 engaged on the ledges 18 of the cabinet 11, the holder 10 is conditioned for placement of an ice cream container 12 or the like. The container 12, when placed into the cabinet 11 and supported on the bottom support 30, may be vertically adjusted to the proper location by turning the adjusting jacking rods 31 in either direction, but the upper beaded rim 27 thereof must be lowered below the top wall 20 of the drip tray 19 before the annular retainer ring 32 is installed, as will now be described.

The retaining collar 32 is assembled by orienting the locking tabs 34 thereof with the recesses 33 of the drip tray opening 24. It will be noted that the ribs 60 of the collar 32 are offset 45° from the locking tabs 34 and, accordingly, when the collar 32 is seated against the top wall 20 of the drip tray 19 and turned 45°, the seating surface 54 of the horizontal flange 53 will guide the collar in relative rotation so that the slot 55 will receive the drip tray top wall 20 to removably lock the collar 32 thereon. The ribs 60 are turned to a position aligned with the handles 46 to assure the positioning of the locking tabs 34 intermediate of the recesses 33. The handles 46 are then equally rotated until the container 12 is raised firmly against the horizontal wall 56 of the collar 32. In addition, due to depletion of the contents of the container 12 or other reason for so-called container collapse, the handles can be further rotated to raise the bottom support 30 and restore the rigid condition of the container 12 between the collar 32 and bottom support 30. It will be readily apparent that empty containers or the like can be removed from the cabinet 11 by turning the handles 46 to rotate the rods 31 in the opposite direction and lower the bottom support 30 whereby the retaining collar 32 is removable by rotation 45° so that the tabs 34 are aligned with and removable through the opening recesses 33.

From the foregoing description it will be readily apparent that the present container holder meets the various objectives and advantages set forth, and that changes and modifications may be made by those skilled in the art to adapt the inventive concept to similar applications. Accordingly, the invention is only limited by the scope of the claims which follow.

What is claimed is:

1. In a refrigerated cabinet operating at low refrigeration temperatures sufficient to maintain ice cream in a frozen dispensable condition, including a closed cabinet housing having a removable top plate with at least one opening adapted to receive a container for bulk ice cream; the improvement comprising multiple spaced apart cut-outs formed in said top plate in communication with said opening, and a container holder including an annular top retaining collar having outwardly extending means receivable in said cut-outs and movable laterally therefrom to removably lock said retaining collar with the top plate, said retaining collar having inwardly extending means to define a smaller opening for access to said container, bottom support means disposed below said retaining collar to support said container, and vertical adjusting rods extending through said top plate and threadedly engaged with said bottom support for vertically adjusting the bottom support to firmly engage the top of said container against said top retaining collar.

2. A container holder for use in a refrigerated cabinet having a top plate with an opening to receive a container of refrigerated product to be dispensed, said holder including a bottom support in spaced relation below the opening in the top plate and adapted to seat the container, top retaining means adapted to be positioned in the opening and removably locked with said top plate, said top retaining means including an inwardly extending abutment portion defining a central opening for access to the container, said abutment portion being spaced from said bottom support and adapted to be engaged by a container seated on the bottom support, and vertical means having an upper portion journalled substantially in the plane of said top plate and a lower end adjustably engaged with said bottom support whereby the bottom support is adapted to be vertically adjusted relative to the top retaining means for removably securing the container therebetween.

3. The container holder according to claim 2, in which spaced recesses extend outwardly from said opening in said top plate, and said top retaining means has peripheral flange means adapted to cover said recesses.

4. The container holder according to claim 3, in which locking tabs are formed on said top retaining means below said peripheral flange, said locking tabs being in spaced relation corresponding to the spacing of said spaced recesses in said top plate.

5. The container holder according to claim 4, in which said opening is circular and said top retaining means is annular, said top retaining means being removably locked with said top plate by alignment of said locking tabs with said recesses and relative rotational movement of said top retaining means and said top plate to position said flange means and locking tabs above and below said top plate in an offset relation from said top plate recesses.

6. The container holder according to claim 5, in which said annular retaining means has a main body portion of L-shaped configuration including an annular inner beaded portion defining said central opening, and an outer vertical portion on which said peripheral flange means and locking tabs are formed.

7. The container holder according to claim 6, in which said annular retaining means includes spaced apart rib means extending radially outwardly on the exterior of said L-shaped body between said beaded portion and said peripheral flange means.

8. The container holder according to claim 7, in which said recesses of said top plate are quadrantially located about the circumference of said circular opening, and said locking tabs are quadrantially positioned on said top retaining means, and said rib means are arranged in circumferential displacement from said locking tabs for locating the locking tabs in interlocking relationship with said top plate.

9. The container holder according to claim 2, in which said bottom support comprises a cross strap diametrally disposed with respect to said top plate opening and said container, and said vertical means are journalled in said top plate and are threadedly engaged with said cross strap.

10. The container holder according to claim 9, in which said cross strap has a main supporting portion of sufficient length to accommodate varying sizes of containers, and end flanges offset from said main portion at each end thereof for said threaded engagement with said vertical means.

11. The container holder according to claim 10, in which said adjustable means comprises vertical adjusting rods having handle means at the upper ends disposed above said top plate.

* * * * *